US005486244A

United States Patent [19]

Caron et al.

[11] Patent Number: 5,486,244

[45] Date of Patent: Jan. 23, 1996

[54] PROCESS FOR IMPROVING THE BEND FORMABILITY OF COPPER ALLOYS

[75] Inventors: Ronald N. Caron, Branford; John F. Breedis, Trumbull, both of Conn.

[73] Assignee: Olin Corporation, New Haven, Conn.

[21] Appl. No.: 233,147

[22] Filed: Apr. 25, 1994

Related U.S. Application Data

[63] Continuation-in-part of Ser. No. 135,760, Oct. 18, 1993, Pat. No. 5,370,840, which is a continuation of Ser. No. 971,499, Nov. 4, 1992, Pat. No. 5,306,465.

[51] Int. Cl.[6] ..... C22F 1/08

[52] U.S. Cl. ..... 148/554

[58] Field of Search ..... 148/554, 432

[56] References Cited

U.S. PATENT DOCUMENTS

| | | |
|---|---|---|
| 2,025,662 | 12/1936 | Hensel et al. . |
| 2,479,311 | 8/1949 | Christensen et al. . |
| 3,194,655 | 7/1965 | Pels et al. . |
| 3,392,016 | 7/1968 | Opie et al. . |
| 3,928,028 | 12/1975 | Yarwood . |
| 4,047,980 | 9/1977 | Watson et al. . |
| 4,049,426 | 9/1977 | Watson et al. . |
| 4,224,066 | 9/1980 | Watson et al. . |
| 4,589,930 | 5/1986 | Kumagal . |
| 4,594,221 | 6/1986 | Caron et al. . |
| 4,631,237 | 12/1986 | Dommer et al. . |
| 4,728,372 | 3/1988 | Caron et al. . |
| 4,749,548 | 6/1988 | Akutsu et al. . |
| 4,872,048 | 10/1989 | Akutsu et al. . |
| 5,004,520 | 4/1991 | Tsuji et al. . |
| 5,017,250 | 5/1991 | Ashok . |

FOREIGN PATENT DOCUMENTS

| | | |
|---|---|---|
| 0023362 | 4/1981 | European Pat. Off. . |
| 1157163 | 7/1969 | United Kingdom . |
| 1353430 | 5/1974 | United Kingdom . |
| 1373049 | 11/1974 | United Kingdom . |
| 1414289 | 11/1975 | United Kingdom . |
| 1525355 | 9/1978 | United Kingdom . |
| 1549107 | 7/1979 | United Kingdom . |
| 1566776 | 5/1980 | United Kingdom . |
| 2070057A | 9/1981 | United Kingdom . |
| 2159836A | 12/1985 | United Kingdom . |

OTHER PUBLICATIONS

31 Copper–Iron–Titanium Precipitation Hardenable Dilute Alloys for Terminal and Connector Applications by H. Yamaguchi and S. Yamasaki (Mitsui Mining Smelting Co. Ltd., Tokyo, Japan) at pp. 517–525.

Metals Handbook—Tenth Edition, vol. 2; Properties and Selection: Nonferrous Alloys and Special–Purpose Materials. "Properties of Wrought Coppers and Copper Alloys" revised by Peter Robinson, Olin Corporation.

Journal of Materials Science 21 (1986) 1357–1362. "Effect of Heat Treatment on Precipitation Behavior in a Cu–Ni–Si–P Alloy" by Y. K. Kim and A. J. Ardell.

"Precipitation in Dilute Cu Fe Ti Alloy: an Atom–Probe Study" by P. Pareige, S. Chambreland; D. Blavette. Microanalyse Quantitative, appearing in Memoires et Etudes Scientifiques Revue de Metallurgie—May 1992.

*Primary Examiner*—Deborah Yee

*Attorney, Agent, or Firm*—Gregory S. Rosenblatt

[57] ABSTRACT

There are disclosed processing methods to improve the properties of copper base alloys containing chromium and zirconium. One method of processing results in a copper alloy having high strength and high electrical conductivity. A second method of processing results in a copper alloy with even higher strength and a minimal reduction in electrical conductivity. While a third method of processing results in a copper alloy having improved bend formability.

9 Claims, 6 Drawing Sheets

PROCESS FOR IMPROVING THE BEND FORMABILITY OF COPPER ALLOYS

CROSS-REFERENCE TO RELATED APPLICATION

This application is a continuation in part of U.S. patent application Ser. No. 08/135,760 filed Oct. 18, 1993, now U.S. Pat. No. 5,370,840 which is a continuation in part of U.S. patent application Ser. No. 07/971,499 filed Nov. 4, 1992, now U.S. Pat. No. 5,306,465 to Caron et al.

FIELD OF THE INVENTION

This invention relates to copper alloys having high strength and high electrical conductivity. More particularly, copper-zirconium-chromium base alloys useful for electrical and electronic applications are processed for improved bend formability. The improved bend formability is achieved by the inclusion of two or more recrystallization anneals upstream of a solutionizing heat treatment.

BACKGROUND OF THE INVENTION

Electrical components such as connectors and electronic components such as leadframes are manufactured from copper alloys to exploit the high electrical conductivity of copper. Pure copper such as C10200 (oxygen-free copper having a minimum copper content by weight of 99.95%) has a yield strength in a spring temper of about 37 kg/mm$^2$ (52 ksi) which is too weak for applications in which the component is subject to forces associated with insertion and removal. To increase the strength of copper, a wide array of alloying elements have been added to copper. In most cases, there is a tradeoff between the increase in yield strength achieved by the alloying addition with a resultant decrease in the electrical conductivity.

Throughout this application, alloy designations such as C10200 utilize the Unified Numbering System designations. Compositional percentages are in weight percent unless otherwise noted.

For electrical and electronic applications zirconium and mixtures of zirconium and chromium are frequently added to copper. For example, copper alloy C15100 (nominal composition 0.05–0.15% zirconium and the balance copper) has an electrical conductivity of 95% IACS (IACS stands for International Annealed Copper Standard where unalloyed copper is defined as having an electrical conductivity of 100% IACS). C15100 has a spring temper yield strength of no more than 46 kg/mm$^2$ (66 ksi). A copper-zirconium intermetallic phase precipitates from the copper matrix as a discrete second phase following heat treatment (precipitation hardening) increasing the strength of the alloy. However, the yield strength of C15100 is still too low for the current trend to higher strength connectors and leadframes in miniaturized applications.

Higher strength is obtained by adding a mixture of chromium and zirconium to copper. C18100 (nominal composition 0.4%–1.2% chromium, 0.08%–0.2% zirconium, 0.03–0.06% magnesium and the balance copper) has an electrical conductivity of 80% IACS at a yield strength of from 47–50 kg/mm$^2$ (67 to 72 ksi). The electrical conductivity of C18100 is acceptable, however, the yield strength is slightly lower than desired. Also, a chromium content above the maximum solid solubility of chromium in copper, about 0.65% for a copper/chromium binary alloy, leads to large second phase dispersions which contribute to a poor surface quality and non-uniform chemical etching characteristics.

For leadframes requiring high heat dissipation to prolong semiconductor device life and electrical connectors carrying high currents where ohmic heating is detrimental, it is desirable to have an electrical conductivity above about 70% IACS and a yield strength above about 56 kg/mm$^2$ (80 ksi).

The alloy should have good stress relaxation resistance properties both at room temperature and at elevated (up to 200° C.) service temperatures. When an external stress is applied to a metallic strip, the metal reacts by developing an equal and opposite internal stress. If the metal is held in a strained position, the internal stress will decrease as a function of both time and temperature. This phenomenon, called stress relaxation, occurs because of the conversion of elastic strain in the metal to plastic, or permanent strain, by microplastic flow. Copper based electrical connectors are frequently formed into spring contact members which must maintain above a threshold contact force on a mating member for prolonged times. Stress relaxation reduces the contact force to below the threshold leading to an open circuit. Copper alloys for electrical and electronic applications should, therefore, have high resistance to stress relaxation at both room and high ambient temperatures.

The minimum bend radius (MBR) determines how severe a bend may be formed in a metallic strip without "orange peeling" or fracture along the outside radius of the bend. The MBR is an important property of leadframes where the outer leads are bent at a 90° angle for insertion into a printed circuit board. Connectors are also formed with bends at various angles. Bend formability, MBR/t, where t is the thickness of the metal strip, is the ratio of the minimum radius of curvature of a mandrel around which the metallic strip can be bent without failure and the thickness of the metal.

$$\frac{MBR}{t} = \frac{\text{Radius of Curvature of Mandrel}}{\text{Thickness of Metal.}}$$

An MBR/t of under about 2.5 is desired for bends made in the "good way", bend axis perpendicular to the rolling direction of the metallic strip. An MBR of under about 2.5 is desired for bends made in the "bad way", bend axis parallel to the rolling direction of the metallic strip.

In summary, a desirable copper alloy for electrical and electronic applications would have the combination of all of the following properties:

Electrical conductivity greater than 70% IACS.

Yield strength greater than 56 kg/mm$^2$ (80 ksi).

Resistance to stress relaxation at a temperature as high as 200° C.

MBR/t less than 2.5 in the "good way" and "bad way".

The copper alloy should resist oxidation and etch uniformly. The uniform etch provides sharp and smooth vertical lead walls on etched leadframes. A uniform chemical etch during precleaning also promotes good coatings by electrolytic or electroless means.

U.S. Pat. No. 4,872,048 to Akutsu et al, discloses copper alloys for leadframes. The patent discloses copper alloys containing 0.05–1% chromium, 0.005–0.3% zirconium and either 0.001–0.05% lithium or 5–60 ppm carbon. Up to about 2% of various other additions may also be present. Two disclosed examples are Alloy 21 (0.98% chromium, 0.049% zirconium, 0.026% lithium, 0.41% nickel, 0.48% tin, 0.63% titanium, 0.03% silicon, 0.13% phosphorous, balance copper) with a tensile strength of 80 kg/mm$^2$ (114 ksi) and an electrical conductivity of 69% IACS and Alloy 75 (0.75% chromium, 0.019% zirconium, 30 ppm carbon, 0.19% cobalt, 0.22% tin, 0.69% titanium, 0.13% niobium, balance copper) with a tensile strength of 73 kg/mm$^2$ (104 ksi) and an electrical conductivity of 63% IACS.

Great Britain Patent Specification No. 1,353,430 to Gosudarstvenny Metallov, discloses copper-chromium-zirconium alloys containing tin and titanium. Alloy 1 contains 0.5% chromium, 0.13% titanium, 0.25% tin, 0.12% zirconium, balance copper with a tensile strength of 62–67 kg/mm$^2$ (88–95 ksi) and an electrical conductivity of 72% IACS.

Great Britain Patent Specification No. 1,549,107 to Olin Corporation, discloses copper-chromium-zirconium alloys containing niobium. Dependent on the method of processing, an alloy containing 0.55% chromium, 0.15% zirconium, 0.25% niobium and the balance copper has a yield stress of from 51–64 kg/mm$^2$ (73–92 ksi) and an electrical conductivity of 71–83% IACS.

SUMMARY OF THE INVENTION

It is apparent that there remains a need in the art for a copper alloy which satisfies the requirements specified above. Accordingly, it is an object of the present invention to provide such an alloy. It is a feature of the invention that the copper alloy is a copper-chromium-zirconium alloy containing specific concentrations of cobalt and titanium; iron and titanium; or cobalt, iron and titanium. Another feature of the invention is that the atomic percent ratio of cobalt to titanium; iron to titanium; or cobalt plus iron to titanium is controlled to provide high conductivity while retaining the strength of the alloy.

It is an advantage of the present invention that the claimed copper alloys have a yield strength above about 56 kg/mm$^2$ (79 ksi) and with the addition of multiple in process aging anneals, the yield strength is increased to above about 62 kg/mm$^2$ (89 ksi). Still another advantage of the invention is that the electrical conductivity of the claimed alloys is above 73% IACS and in some embodiments exceeds 77% IACS. It is a further advantage of the invention that the copper alloys exhibit excellent stress relaxation resistance with over 95% of the stress remaining after exposure to 150° C. for 3,000 hours. Yet a further advantage of the invention is that following some processing embodiments, the MBR/t of the alloy is about 1.7 in the good way and about 1.5 in the bad way for the claimed copper alloys.

Accordingly, there is provided a copper alloy consisting essentially of from an effective amount up to 0.5% by weight chromium; from about 0.05 to about 0.25% by weight zirconium; from about 0.1 to about 1% by weight of M, where M is selected from the group consisting of cobalt, iron and mixtures thereof; from about 0.05% to about 0.5% by weight titanium; and the balance copper.

The above stated objects, features and advantages will become more apparent from the specification and drawings which follows.

DETAILED DESCRIPTION OF THE PREFERRED EMBODIMENTS

Figure 1:
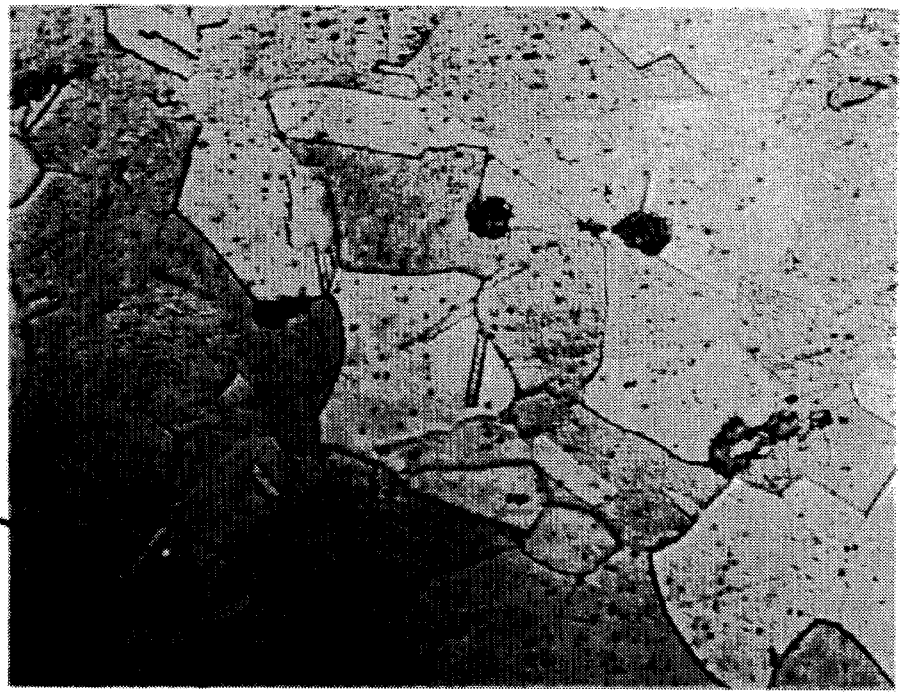
FIG. 1 is a photomicrograph of a copper base alloy containing chromium, zirconium and titanium with nickel as a transition metal addition.

The copper alloys of the invention consist essentially of chromium, zirconium, cobalt and/or iron and titanium. The chromium is present in an amount of from that effective to increase strength through precipitation hardening to about 0.8%. Zirconium is present in an amount from about 0.05% to about 0.40%. Cobalt is present in an amount from about 0.1% to about 1%. Either a portion or all of the cobalt may be substituted with an equal weight percent of iron or another transition element. Titanium is present in an amount of from about 0.05% to about 0.7%. The balance of the alloy is copper.

Chromium

Chromium is present in the alloy in an amount from that effective to increase the strength of the alloy through precipitation hardening (aging) up to about 1.0%. Preferably, the maximum chromium content is about 0.5%. As the maximum solid solubility limit of chromium in the copper alloy is approached, a coarse second phase precipitate develops. The coarse precipitate detrimentally affects both the surface quality and the etching and plating characteristics of the copper alloy without increasing the strength of the alloy.

The cobalt, iron and titanium also present in the alloy combine to form a variety of precipitates including cobalt-X or iron-X, where X is predominantly titanium but includes some chromium and zirconium. As discussed below, a portion of the Ti lattice points are usually occupied by zirconium or chromium. If excess iron, cobalt or titanium remains unreacted and in solid solution in the copper matrix, electrical conductivity is decreased. The chromium ties up additional titanium to reduce this decrease in electrical conductivity. A preferred chromium content is from about 0.1% to about 0.4% and a most preferred chromium content is from about 0.25% to about 0.35%.

Zirconium

The zirconium content is from about 0.05% to about 0.40%. A preferred maximum zirconium content is about 0.25%. If the zirconium content is too low, the alloy has poor resistance to stress relaxation. If the zirconium content is too high, coarse particles form which detrimentally affect both the surface quality and the etching characteristics of the alloy without providing any increase in strength. A preferred zirconium content is from about 0.1% to about 0.2%.

Hafnium is a suitable substitute for a portion or all of the zirconium in the same weight percentages. The extra cost associated with hafnium makes its use less desirable.

Transition Element ("M")

A transition element ("M") selected from the group consisting of cobalt, iron and mixtures thereof, is present in an amount of from about 0.1% to about 1%. While the cobalt and iron are generally interchangeable, iron provides a slight increase in strength (about a 4–5 ksi improvement) with a slight reduction in electrical conductivity (about a 5–6% IACS decrease). If the cobalt and/or iron content is too high, a coarse second phase particle forms during casting. The coarse precipitate detrimentally. affects both the surface quality and the etching characteristics of the alloy. If there is insufficient titanium or chromium such that "M" remains in solid solution in the copper matrix, the electrical conductivity of the alloy is decreased. If the cobalt and/or iron content is too low, the alloy does not undergo precipitation hardening through aging and there is no corresponding increase in the strength of the alloy. A preferred amount of cobalt and/or iron is from about 0.25% to about 0.6%. The most preferred amount is from about 0.3% to about 0.5%.

Applicants believe that some or all of the cobalt and/or iron may be replaced with nickel. However, while the utility of nickel is suggested by the effect of nickel on the electrical conductivity of copper, nickel is less preferred. As shown in Table 1, nickel, when in solid solution in pure copper, has a lesser effect on the electrical conductivity of copper than either cobalt or iron. The conductivity drop from 102.6% IACS represents the drop in conductivity from the highest value presently achieved in high purity copper.

Surprisingly, when the transition metal is precipitated from the solid solution, nickel has a more detrimental effect on electrical conductivity than either cobalt or iron, as shown in Table 2. The alloys of Table 2 were processed by the steps of solutionization anneal, cold roll, age for 2 hours at 500° C. prior to measuring nominal conductivity. The alloys were overaged by heating to 500° C. for 48 hours prior to measuring the maximum conductivity.

TABLE 1

| Elemental Addition (Atomic percent) | Electrical Conductivity % IACS | Conductivity Drop from 102.6% IACS |
|---|---|---|
| 0.64 cobalt | 28.8 | −73.8 |
| 0.64 iron | 22.3 | −80.3 |
| 0.64 nickel | 71.8 | −30.8 |
| 0.64 manganese | 48.3 | −54.3 |

TABLE 2

| Alloy composition (Weight percent) | Nominal Conductivity | Maximum % IACS |
|---|---|---|
| 0.29Cr/0.19Zr/0.19Ti/0.53Co/balance Cu | 75.2 | 85 |
| 0.29Cr/0.20Zr/0.23Ti/0.43Fe/balance Cu | 72.0 | 78 |
| 0.31Cr/0.18Zr/0.24Ti/0.60Ni/balance Cu | 60.4 | 72 |

Figure 2:
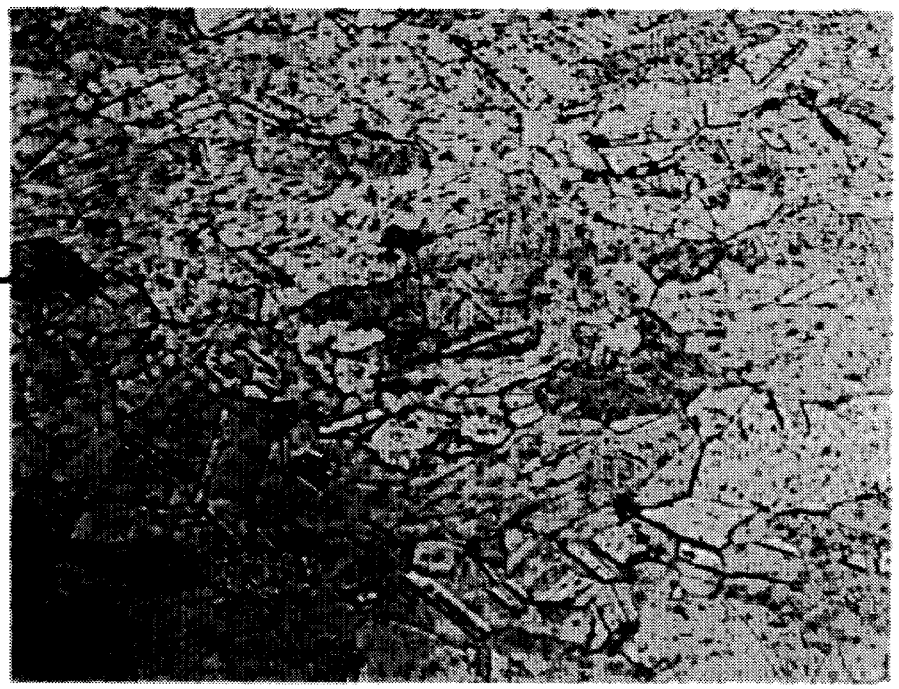
FIG. 2 is a photomicrograph of a copper base alloy containing chromium, zirconium and titanium with cobalt as a transition metal addition.

FIG. 1 is a photomicrograph at a magnification of 1000× of the nickel containing alloy of Table 2 and FIG. 2 is a photomicrograph at a magnification of 1000× of the cobalt containing alloy of Table 2. The nickel containing alloy is populated with coarse second phase precipitates. The cobalt containing alloy is essentially free of coarse second phase precipitates, containing rather, a uniform dispersion of fine particles 4. The coarse precipitate 2 is a potential crack initiation site during rolling or other working and should be avoided. Accordingly, the preferred alloys of the invention contain less than about 0.25% nickel and preferably, less than about 0.15% nickel, and most preferably less than 0.10%.

Other transition elements, such as niobium, vanadium and manganese may be used. A less reactive transition metal, such as manganese, is less preferred. Residual manganese and titanium in solid solution reduce electrical conductivity to unacceptable levels. Niobium and vanadium do not react with titanium but provide elemental dispersoids which increase strength.

Titanium

Figure 3:
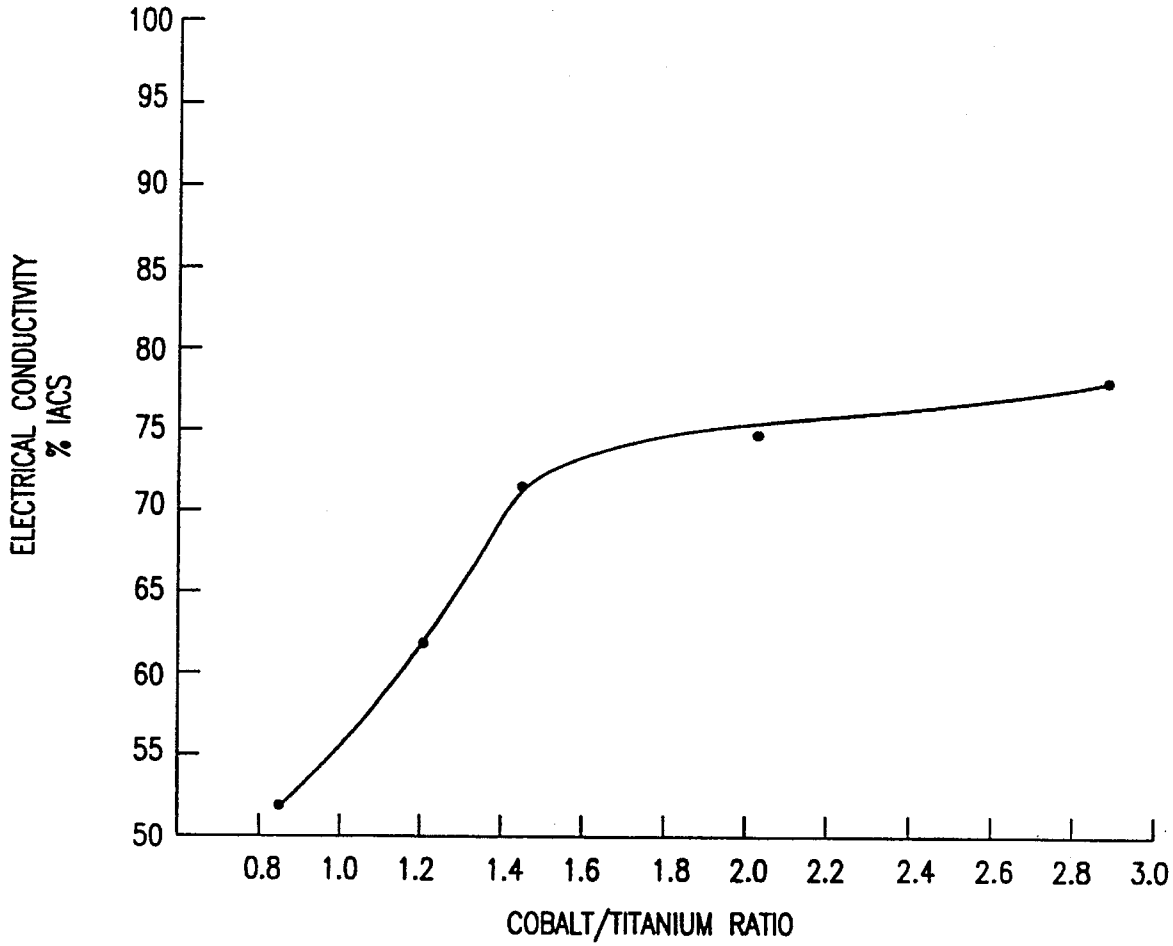
FIG. 3 graphically illustrates the effect of the cobalt/titanium weight percent ratio on the electrical conductivity.

Titanium is present in an amount of from about 0.05% to about 0.7%. The preferred maximum titanium content is about 0.5%. Titanium combines with "M" to form a second phase precipitate having a hexagonal crystallographic structure. The second phase is predominantly of the form CoTi or FeTi. A portion of the Ti lattice points are occupied by zirconium or chromium atoms. The preferred ratio of cobalt and/or iron to titanium is (in weight percent) from about 1.2:1 to about 7.0:1. A more preferred ratio is from about 1.4:1 to about 5.0:1 and a most preferred range is from about 1.5:1 to about 3:1. As the content of the cobalt, iron and titanium vary from the preferred ratios, the excess remains in solid solution in the copper matrix, reducing the electrical conductivity of the alloy. This effect is graphically illustrated in FIG. 3 which compares the Co/Ti ratio to electrical conductivity. The electrical conductivity decreases dramatically at a ratio of about 1.2:1 and the ratio should be maintained above that value.

Additions

The alloys of the invention may have properties tailored for specific applications by the additions of small amounts of other elements. The additions are made in an amount effective to achieve the desired property enhancement without significantly reducing desirable properties such as electrical conductivity or bend formability. The total content of these other elements is less than about 5% and preferably less than about 1%.

Magnesium may be added to improve solderability and solder adhesion. A preferred magnesium content is from about 0.05% to about 0.2%. Magnesium could also improve the stress relaxation characteristics of the alloy.

Machinability, without a significant decrease in electrical conductivity, can be enhanced by additions of sulfur, selenium, tellurium, lead or bismuth. These machinability enhancing additions form a separate phase within the alloy and do not reduce electrical conductivity. A preferred content is from about 0.05% to about 3%.

Deoxidizers can be added in preferred amounts of from about 0.001% to about 0.1%. Suitable deoxidizers include boron, lithium, beryllium, calcium, and rare earth metals either individually or as misch metal. Boron, which forms borides, is beneficial as it also increases the alloy strength.

Additions which increase strength, with a reduction in electrical conductivity, including aluminum and tin may be added in amount of up to 1%.

For a lower cost alloy, up to 20% of the copper may be replaced with zinc. The zinc diluent reduces cost and provides the alloy with a yellow color. A preferred zinc content is from about 5% to about 15%.

Figure 5:
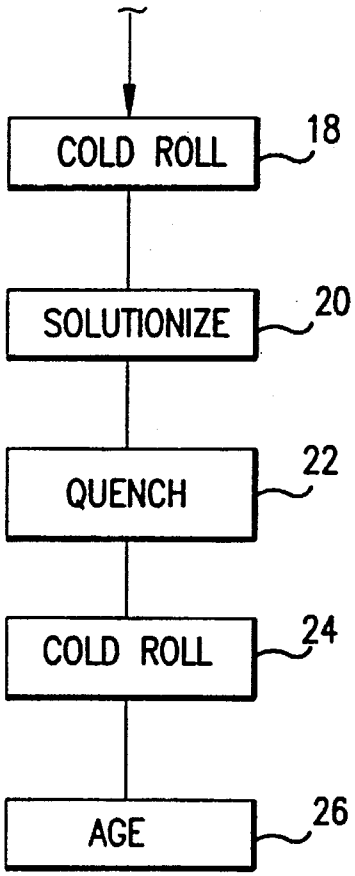
FIG. 5 shows in block diagram a first embodiment to further process the copper alloy for high strength and high electrical conductivity.
Figure 4:
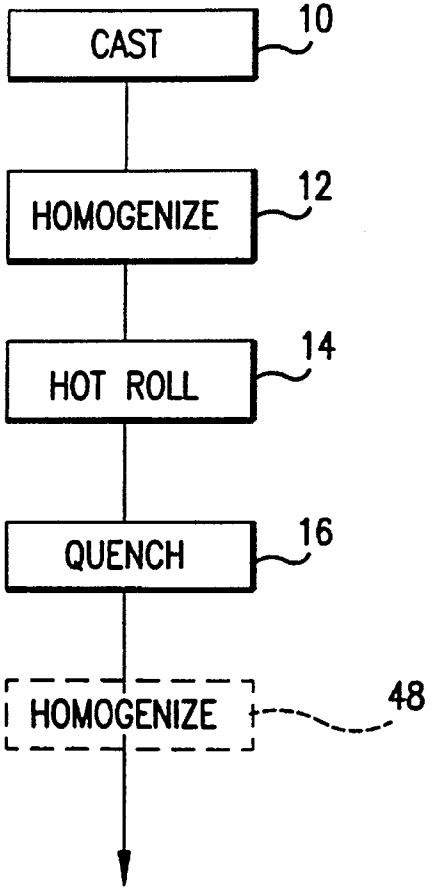
FIG. 4 shows in block diagram the initial processing of a copper alloy containing chromium, zirconium, cobalt and/or iron, and titanium in accordance with the invention.
Figure 6:
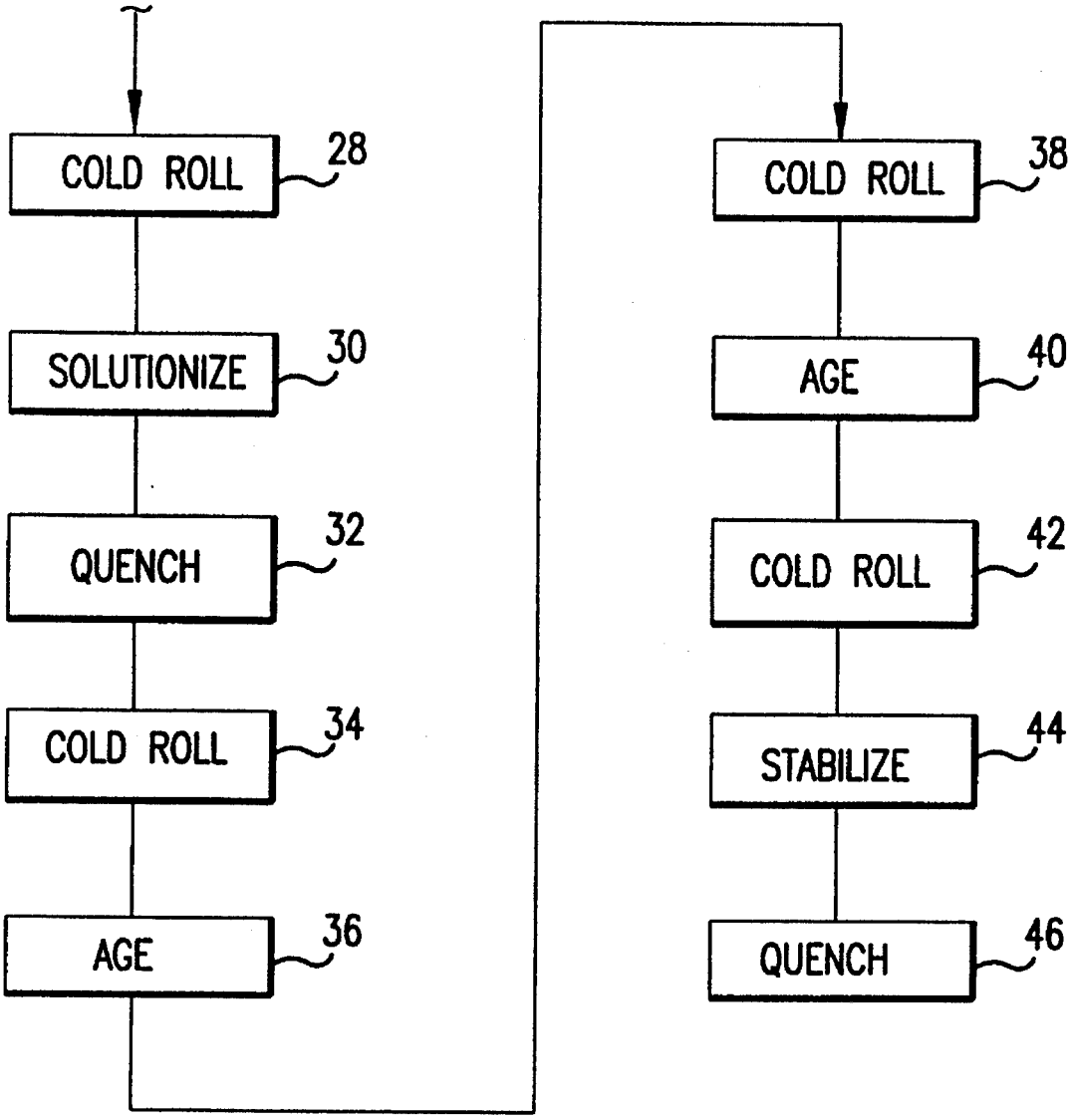
FIG. 6 shows in block diagram a second embodiment to further process the copper alloy with extra high strength with a minimal loss of electrical conductivity.

The alloys of the invention are formed by any suitable process. Two preferred methods are illustrated in FIGS. 4–6. FIG. 4 illustrates in block diagram the process steps generic to both preferred methods. FIG. 5 illustrates subsequent processing steps to produce an alloy having both high strength and high electrical conductivity. FIG. 6 illustrates in block diagram alternative processing steps to produce an alloy having even higher strength, with a minimal sacrifice in electrical conductivity.

With reference to FIG. 4, the alloys are cast 10 by any suitable process. In one exemplary process, cathode copper is melted in a silica crucible under a protective charcoal cover. The desired amount of cobalt and/or iron is then added. Titanium is added next to the melt, followed by chromium and zirconium. The melt is then poured into a steel mold and cast into an ingot.

The ingots are then heated prior to rolling 12 to a temperature generally between about 850° C. and 1050° C. for from about 30 minutes to about 24 hours which also at least partially homogenizes the alloy. Preferably, heating is to about 900° C.–950° C. for about 2–3 hours.

Alternatively, the ingot is cast directly into a thin slab, known in the art as "strip casting". The slab has a thickness of from about 2.5 mm to about 25 mm (0.1–1 inch). The cast strip is then either cold rolled or treated by a post casting recrystallization/homogenization anneal and then cold rolled.

Following homogenization 12, the ingot is hot rolled 14 to a reduction in excess of about 50% and preferably to a reduction on the order of from about 75% to about 95%. Throughout this application, reductions by rolling are given as reductions in cross sectional area unless otherwise specified. The hot roll reduction 14 may be in a single pass or require multiple passes. Immediately following the last hot roll reduction 14, the ingot is rapidly cooled to below the aging temperature, typically by quenching 16 in water to room temperature to retain the alloying elements in solid solution. Each of the quench steps specified in Applicants' processes are preferred, but optional, each quench step may be replaced with any other means of rapid cooling known in the art.

Following quenching 16, two different sequences of processing steps result in alloys with slightly different properties. A first process (designated "Process 1") is illustrated in FIG. 5. The alloy achieves high strength and high electrical conductivity. A second process (designated "Process 2") achieves higher strength with a minimal sacrifice of electrical conductivity.

FIG. 5 illustrates Process 1. The alloy is cold rolled 18 to a reduction in excess of about 25% and preferably to a reduction of from about 60% to about 90%. The cold roll 18 may be a single pass or multiple passes with or without intermediate recrystallization anneals. Following the cold roll 18, the alloy is solutionized 20 by heating to a temperature from about 750° C. to about 1050° C. for from about 30 seconds to about 2 hours. Preferably, the solutionization 20 is at a temperature of from about 900° C. to about 925° C. for from about 30 seconds to 2 minutes.

The alloy is next quenched 22 and then cold rolled 24 to final gauge. The cold roll 24 is a reduction in excess of about 25% and preferably in the range of from about 60% to about 90%. The cold roll 24 may be a single pass or in multiple passes with or without intermediate recrystallization anneals.

After the alloy is reduced to final gauge by cold roll 24, the alloy strength is increased by a precipitation aging 26. The alloy is aged by heating to a temperature of from about 350° C. to about 600° C. for from about 15 minutes to about 16 hours. Preferably, the alloy is heated to a temperature of from about 425° C. to about 525° C. for from about 1 to about 8 hours. Process 1 is utilized when the optimum combination of strength, electrical conductivity, and formability is required.

If higher strength is required, at a slight reduction in electrical conductivity, Process 2 as illustrated in FIG. 6 is utilized. Following the quench 16 (FIG. 4), the alloy is cold rolled 28 to solutionizing gauge. The cold roll reduction is in excess of about 25% and preferably in the range of from about 60% to about 90%. The cold roll step 28 may be a single pass or multiple passes with or without intermediate recrystallization anneals.

Following cold rolling 28, the alloy is solutionized 30 by heating to a temperature of from about 750° C. to about 1050° C. for from about 15 seconds to about 2 hours. More preferably, the solutionizing temperature is from about 900° C. to about 925° C. for from about 30 seconds to about 2 minutes. Following solutionizing 30, the alloy is rapidly cooled such as by quenching 32, typically in water, to below the aging temperature.

The alloy is then cold rolled 34 to a reduction of from about 25% to about 50%. The reduction may be a single pass or multiple passes with intermediate solutionizing recrystallization anneals. Following the cold roll 34, the alloy is age hardened 36 at temperatures sufficiently low to avoid recrystallization. The aging 36 is preferably at a temperature of from about 350° C. to about 600° C. for a time of from about 15 minutes to about 8 hours. More preferably, the non-recrystallizing precipitation hardening treatment 36 is at a temperature of from about 450° C. to about 500° C. for from about 2 to about 3 hours.

Following the non-recrystallizing aging 36, the alloy is cold rolled 38 to a reduction of from about 15% to about 60%. Following the cold roll step 38, the alloy is optionally given a second non-recrystallizing precipitation hardening anneal 40 at a temperature in the range of from about 350° C. to about 600° C. for from about 30 minutes to about 5 hours. Preferably, this optional second non-recrystallizing precipitation hardening anneal 40 is at a temperature of from about 450° C. to about 500° C. for from about 2 to 4 hours. The precise time and temperature for the second optional non-recrystallizing precipitation hardening step 40 is selected to maximize the electrical conductivity of the alloy.

The alloy is then cold rolled 42 by from about 35% to about 65% reduction to final gauge in single or multiple passes, with or without intermediate sub-recrystallization anneals. Following the cold roll 42, the alloy is given a stabilization relief anneal 44 at a temperature of from about 300° C. to about 600° C. for from about 10 seconds to about 10 minutes for a strand anneal. For a bell anneal, the stabilization relief anneal 44 is at a temperature of up to about 400° C. for from about 15 minutes to about 8 hours. More preferred is a bell anneal at about 250° C. to about 400° C. for from about 1 to about 2 hours. Following the stabilization anneal 44, the alloy is quenched 46 if strand annealed. A quench is generally not utilized following a bell anneal. Process 2 produces an alloy having maximum strength with a minimal sacrifice in electrical conductivity.

In another process embodiment, an homogenization anneal (reference numeral 48 in FIG. 4) is included with either Process 1 or Process 2. The homogenization anneal 48 is inserted between the hot roll step 14 and the solutionizing step (20 in FIG. 5 or 30 in FIG. 6), before or after the cold roll step (18 in FIG. 5 or 28 in FIG. 6). The homogenization anneal 48 is at a temperature of from about 350° C. to about 750° C. for from about 15 minutes to about 8 hours. Preferably, the homogenization anneal 48 is at a temperature of from about 550° C. to about 650° C. for from about 6 to about 8 hours.

Generally, the alloys made by Process 1 are utilized where high strength, high electrical conductivity and formability are required such as in connector and leadframe applications. Process 2 is utilized in applications where higher strength and excellent stress relaxation resistance are required and some minimal loss in electrical conductivity is tolerated, for example, electrical connectors subject to elevated temperature such as for automotive applications as well as leadframes requiring high strength leads. While particularly applicable to the alloys of the invention, both Process 1 and Process 2 have utility for all copper based alloys containing chromium and zirconium, such as copper alloy C18100.

Figure 7:
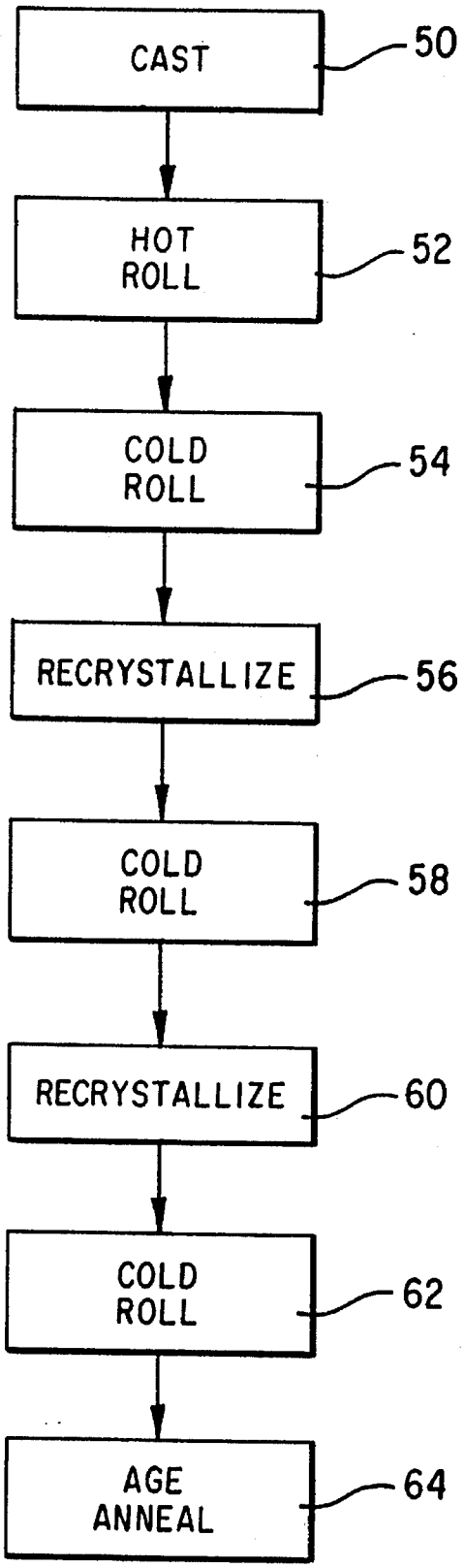
FIG. 7 shows in block diagram a third embodiment to process the copper alloy for improved bend formability.

A third process to impart improved bend formability capability to the alloys of the invention is illustrated in block diagram in FIG. 7. The process improves the minimum bend radius in both the good way and the bad way for the alloys of the invention. In addition, this third process has been found to improve the MBR for other copper-chromium-zirconium alloys such as C18100.

Copper alloys containing from about 0.001% to about 2.0% chromium and from about 0.001% to about 2.0% zirconium are cast 50 into an ingot by any suitable process such as melting in a silica crucible under a protective charcoal cover. The surfaces of the ingot are then preferably milled to remove surface oxides.

The ingot is then heated to a temperature of from about 850° C. to about 1050° C., and preferably from about 875° C. to about 950° C. for a time of from about 30 minutes to about 24 hours. Preferably the time at this elevated temperature is from about 1 to about 4 hours. The elevated temperature heat soak at least partially homogenizes the alloy.

The alloy is then hot rolled 52 to a reduction, in cross sectional area, of in excess of about 50% and preferably to a reduction of from about 75% to about 95%. The hot roll 52 reduction may be in a single pass or in multiple passes. Preferably, the strip is rapidly cooled to room temperature, such as by water quenching, immediately after completion of hot rolling. Surface oxides are then, preferably, removes such as by milling.

The copper alloy strip is next cold rolled 54 to a cross sectional area reduction in excess of about 25% and preferably of from about 30% to about 90%.

After cold rolling, the copper alloy strip is subjected to a first recrystallization anneal 56. The first recrystallization anneal is at any suitable recrystallization temperature. As shown in the Examples which follow, the first recrystallization anneal is effective as a high temperature solution anneal (925° C.), a low temperature solution anneal (830° C.) and as an overaging recrystallization anneal (650° C.). Generally, the first recrystallization anneal 56 is at a temperature of from about 500° C. up to the solidus temperature of the copper alloy. Preferably, the first recrystallization 56 is at a temperature of from about 800° C. to about 950° C. The dwell time for the first recrystallization anneal is from about 5 seconds to about 16 hours and preferably from about 30 seconds to about 5 minutes for a trip anneal and for about 30 minutes to about 10 hours for a bell anneal.

After the first recrystallization anneal 56, the copper alloy strip is further cold rolled 58 to a cross sectional area reduction of from about 40% to about 90% and preferably of from about 50% to about 80%.

The copper alloy strip is next subjected to a second recrystallization anneal 60 at any effective temperature of from about 600° C. to the solidus point of the copper alloy. The temperature of the second recrystallization anneal is more dependent on the alloy composition than the first recrystallization anneal because it must effectively solutionize the alloy to produce the desired aging response during the precipitation aging step. For copper alloys containing chromium and zirconium, the preferred second recrystallization temperature is from about 800° C. to about 950° C. The dwell time for the copper alloys is from about 5 seconds to about 60 minutes and preferably from about 30 seconds to about 5 minutes.

An optional water quench may follow either the first or second recrystallization anneal, or both. It is particularly desirable to provide a quench after the second recrystallization anneal 60 to provide the desired aging response during the precipitation aging step. Following the second recrystallization anneal, the cold roll 58 and second recrystallization anneals may be repeated one or more additional times.

The copper strip is then cold rolled 62 to final gauge, which is usually from about 0.13 mm (0.005 inch) to about 0.38 mm (0.015 inch) for leadframe strip and up to 2.5 mm (0.10 inch) for connectors.

After the alloy is reduced to final gauge by cold roll 62, the alloy strength is increased by a precipitation aging treatment 64. The proper aging treatment is dependent on the alloy composition, preage cold work history, solutionization treatment and the desired combination of alloy properties. The alloy is aged by heating to a temperature of from about 350° C. to about 600° C. for from about 15 minutes to about 16 hours. Preferably, the alloy is heated to a temperature of from about 425° C. to about 525° C. for from about 1 to about 8 hours.

Figure 8:
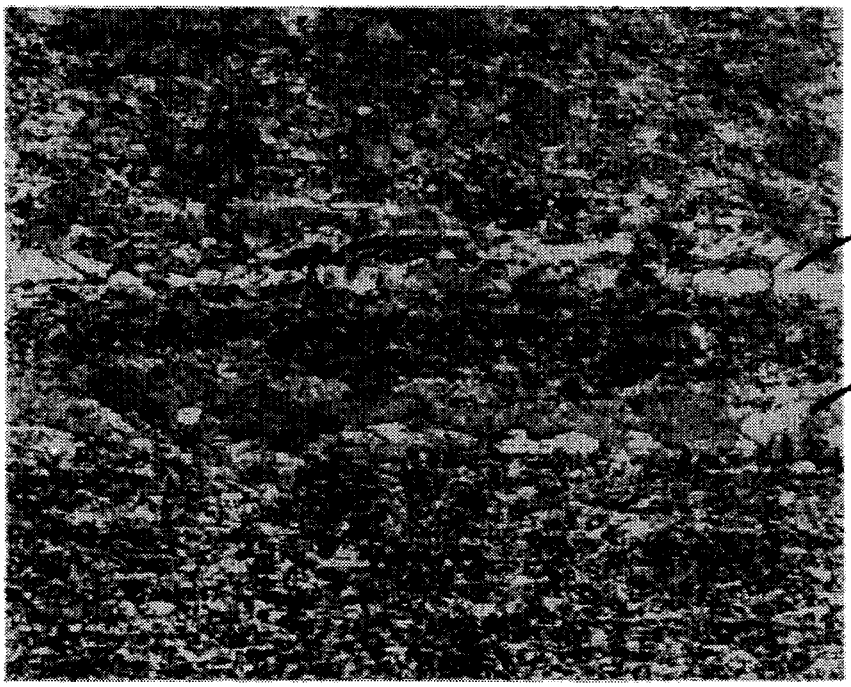
FIG. 8 is a photomicrograph of the copper alloy of the invention after a first recrystallization anneal.
Figure 9:
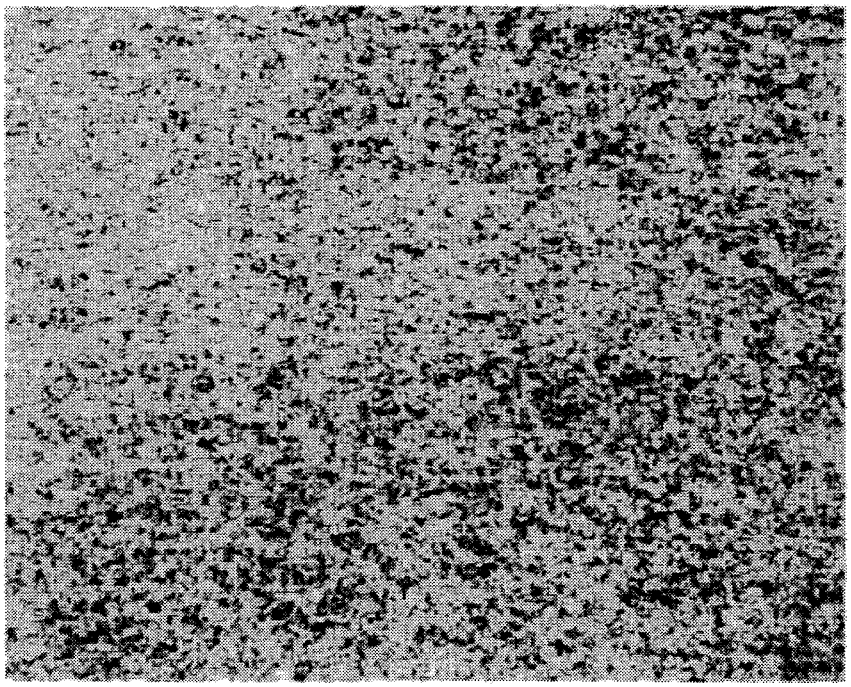
FIG. 9 is a photomicrograph of the copper alloy of the invention after a second recrystallization anneal.

The advantage of the second recrystallization anneal in copper-chromium-zirconium alloys is illustrated by the photomicrographs of FIGS. 8 and 9. The photomicrographs are a cross sectional view along a longitudinal edge of the strip. FIG. 8 illustrates the structure at a magnification of 100× after the first recrystallization anneal. Coarse banded regions 66 form longitudinally running striations through the strip. The coarse grain striations remain in the structure during subsequent processing and are believed to lead to bend failures in the form of cracking or heavy wrinkling of the strip.

FIG. 9 illustrates the same strip after the second recrystallization anneal. The crystalline grains are fine and equiaxed with an average grain size between about 2 microns and about 60 microns and preferably between about 5 microns and about 15 microns.

The advantages of the alloys of the invention will be apparent from the Examples which follow. The Examples are intended to be exemplary and not to limit the scope of the invention.

EXAMPLES

The electrical and mechanical properties of the alloys of the invention were compared with copper alloys conventionally used in leadframe and connector applications. Table 3 lists the alloy compositions. The alloys preceded by an asterisk, H, I and P are alloys of the invention while other alloys are either conventional alloys or, as to alloys G, K and L, variations of preferred compositions to illustrate either the contribution of chromium or the ratio of "M" to titanium.

TABLE 3

| Alloy | Alloy Composition Zr | Cr | Co | Fe | Ti | Mg | Other |
|---|---|---|---|---|---|---|---|
| A | 0.13 | 0.80 | — | — | — | 0.08 | |
| B | 0.20 | 0.32 | — | — | — | 0.06 | |
| C | 0.25 | — | — | — | — | — | |
| D | 0.25 | 0.27 | 0.23 | — | — | — | |
| E | 0.21 | 0.25 | — | 0.32 | — | — | |
| F | 0.21 | 0.32 | — | — | 0.21 | — | |
| G | 0.21 | — | — | 0.43 | 0.23 | — | |
| *H | 0.20 | 0.30 | 0.46 | — | 0.24 | — | |
| *I | 0.20 | 0.29 | — | 0.43 | 0.23 | — | |
| J | 0.20 | 0.26 | 0.25 | 0.27 | 0.22 | — | |
| K | 0.20 | 0.35 | 0.28 | — | 0.24 | — | |
| L | 0.20 | 0.37 | — | 0.24 | 0.24 | — | |
| M | 0.19 | — | 0.66 | — | 0.23 | — | |
| N | — | — | — | 0.6 | — | 0.05 | 0.18 P |
| O | — | 0.3 | — | — | 0.1 | — | 0.02 Si |
| *P | 0.20 | 0.3 | 0.5 | — | 0.2 | — | |
| Q | 0.10 | — | — | — | — | — | |
| R | 0.25 | 0.27 | 0.23 | — | — | — | |

Alloys A through M and P were produced by the method described above. A 5.2 kg (10 pound) ingot of each alloy was made by melting cathode copper in a silica crucible under a protective charcoal cover, charging the required cobalt and/or iron additions, then adding the chromium and titanium addition followed by zirconium and magnesium as required for the particular alloy. Each melt was then poured into a steel mold which upon solidification produced an ingot having a thickness of 4.45 cm (1.75 inches) and a length and width both 10.16 cm (4 inches). Alloys N and O are commercial alloys acquired as strip having an H08 (spring) temper. Alloy Q is alloy C15100 acquired as commercially produced strip in a HR04 (hard relief anneal) temper.

Table 4 shows the electrical and mechanical properties of alloys A through M and R processed by Process 1. Alloys H, I and J have a higher strength than base line copper zirconium alloys (alloy C) as well as base line copper chromium zirconium alloys (alloy B). Surprisingly, alloys H, I and J which have about 0.30 weight percent chromium have a yield strength and ultimate tensile strength about equal to alloy A which has a chromium content almost three times as high.

The effect of chromium on enhancing conductivity is illustrated by comparing alloy G and alloy I. The only significant difference in composition between the alloys is the presence in alloy I of 0.29% chromium. The electrical conductivity of alloy I, 72.0% IACS, is significantly higher than the conductivity of alloy G 65.1% IACS.

The criticality of the weight ratio of 2:1 for the (cobalt and/or iron):titanium is demonstrated by comparing alloys H and I which have the ratio of 2:1 to alloys K and L which have a ratio of about 1:1. While the strengths of alloys H and I and alloys K and L are approximately equal, the electrical conductivity of alloys K and L are about 20% IACS lower.

TABLE 4

| Alloy | Properties of Alloys Processed According to Process 1: Conductivity % IACS | Yield Strength kg/mm² | Yield Strength ksi | Ultimate Tensile Strength kg/mm² | Ultimate Tensile Strength ksi | Elongation percent | MBR/t (GW/BW) |
|---|---|---|---|---|---|---|---|
| A | 79.0 | 56.7 | 81 | 58.8 | 84 | 9 | 1.7/1.7 |
| B | 77.6 | 52.5 | 75 | 55.3 | 79 | 8 | 1.4/2.3 |
| C | 91.3 | 44.1 | 63 | 46.9 | 67 | 8 | 1.4/1.8 |

TABLE 4-continued

| Alloy | Properties of Alloys Processed According to Process 1: Conductivity % IACS | Yield Strength kg/mm² | Yield Strength ksi | Ultimate Tensile Strength kg/mm² | Ultimate Tensile Strength ksi | Elongation percent | MBR/t (GW/BW) |
|---|---|---|---|---|---|---|---|
| D | 74.7 | 54.6 | 78 | 56.0 | 80 | 8 | 1.4/1.8 |
| E | 62.7 | 52.5 | 75 | 54.6 | 78 | 9 | 2.3/3.1 |
| F | 36.0 | 57.4 | 82 | 60.2 | 86 | 9 | 1.8/3.1 |
| G | 65.1 | 57.4 | 82 | 60.9 | 87 | 10 | 1.8/2.3 |
| *H | 77.5 | 57.4 | 82 | 60.2 | 86 | 8 | 1.8/2.3 |
| *I | 72.0 | 58.1 | 83 | 60.9 | 87 | 9 | 1.8/2.3 |
| J | 73.3 | 55.3 | 79 | 59.5 | 85 | 9 | 1.5/1.8 |
| K | 52.4 | 58.8 | 84 | 60.9 | 87 | 9 | 2.3/2.3 |
| L | 56.6 | 62.3 | 89 | 64.4 | 92 | 10 | 2.3/2.3 |
| M | 70.7 | 49.0 | 70 | 51.1 | 73 | 8 | 1.8/2.3 |
| R | 82.0 | 51.1 | 73 | 53.2 | 76 | 9 | 1.4/1.8 |

Alloys D and R illustrates that for certain applications, the titanium may be eliminated. The copper-chromium-zirconium-cobalt alloys have strengths equal to alloys containing significantly higher chromium with better formability, etching and plating characteristics. The electrical conductivity is higher than that of titanium containing alloys but at a loss of strength. It is believed that the chromium, zirconium and cobalt ranges would be the same as that of the other alloys of the invention.

Table 5 illustrates the properties of alloys A through E, G through J and R when processed by Process 2. The one exception is alloy C which was processed with a single in process aging anneal. Alloy C was cold rolled to 2.54 mm (0.10 inch) gauge from milled hot rolled plate (16 of FIG. 1) solutionized at 900° C. for 30 seconds and then water quenched. The alloy was then cold rolled to a 50% reduction, aged at 450° C. for 7 hours and then cold rolled with a 50% reduction to a final gauge of 0.64 mm (0.025 inch). Alloy C was then relief annealed at 350° C. for 5 minutes.

The alloys of the invention, H, I and J, all have higher strength than the conventional alloys, including commercial alloy C181 (alloy A) which has a chromium content almost three times that of the alloys of the invention. In addition, the significant increase in strength, an increase of 5.6–8.4 kg/mm² (8–12 ksi) for the yield strength, is accompanying by almost no drop in electrical conductivity.

Process 2 results in alloys of the invention with an about 21 kg/mm² (30 ksi) yield strength improvement over binary copper zirconium alloys such as alloy C. The benefit of the chromium addition is apparent by comparing the electrical conductivity of alloy G (0% Cr) with that for alloy I (0.29% Cr). Alloy G has a conductivity of 59.3% IACS alloy I has a conductivity of 75.5% IACS.

TABLE 5

| Alloy | Properties of Alloys Processed According to Process 2: Conductivity % IACS | Yield Strength kg/mm² | Yield Strength ksi | Ultimate Tensile Strength kg/mm² | Ultimate Tensile Strength ksi | Elongation percent | (GW/BW) MBR/t |
|---|---|---|---|---|---|---|---|
| A | 81.0 | 56.7 | 81 | 57.4 | 82 | 7 | 2.2/2.4 |
| B | 82.8 | 50.4 | 72 | 51.8 | 74 | 4 | 2.1/2.9 |
| C | 94.4 | 43.4 | 62 | 44.8 | 64 | 3 | 1.9/3.1 |
| D | 80.5 | 54.6 | 78 | 56.0 | 80 | 4 | 2.4/3.8 |
| E | 70.6 | 53.9 | 77 | 55.3 | 79 | 3 | 2.8/5.2 |

TABLE 5-continued

| Properties of Alloys Processed According to Process 2 | | | | | | | |
|---|---|---|---|---|---|---|---|
| | Conductivity | Yield Strength | | Ultimate Tensile Strength | | Elongation per- | (GW/BW) |
| Alloy | % IACS | kg/mm² | ksi | kg/mm² | ksi | cent | MBR/t |
| G | 59.3 | 62.3 | 89 | 64.4 | 92 | 3 | 2.4/5.0 |
| *H | 77.1 | 65.1 | 93 | 68.6 | 98 | 3 | 2.8/5.2 |
| *I | 75.5 | 64.4 | 92 | 65.8 | 94 | 5 | 3.0/5.2 |
| J | 73.7 | 62.3 | 89 | 65.8 | 94 | 5 | 2.3/5.2 |
| R | 80.5 | 54.6 | 78 | 56.0 | 80 | 4 | 2.4/3.8 |

TABLE 6

| Stress Relaxation - 150° C. Exposure | | | | |
|---|---|---|---|---|
| | Process | Yield Strength | | Percent Stress Remaining After |
| Alloy | Method | kg/mm² | ksi | 3000 hours |
| A | AGED | 56.7 | 81 | 92 |
| A | 2-IPA | 56.7 | 81 | 87 |
| C | AGED | 44.1 | 63 | 89 |
| C | 1-IPA | 43.4 | 62 | 84 |
| D | AGED | 54.6 | 78 | 92 |
| E | AGED | 52.5 | 75 | 96 |
| *H | AGED | 57.4 | 82 | 95 |
| *H | 2-IPA | 65.1 | 93 | 85 |
| *I | AGED | 58.1 | 83 | 96 |
| *I | 2-IPA | 58.1 | 83 | 96 |
| J | 2-IPA | 63.0 | 90 | 96 |
| Q | HD/RA | 39.2 | 56 | 80 |

TABLE 7

| Comparison of Leadframe Alloys | | | | | | |
|---|---|---|---|---|---|---|
| Al- | Conductivity | Yield Strength | | MBR/t GW/ | % Stress Remaining 105° C. - | % Stress Remaining 125° C. - |
| loy | % IACS | kg/mm² | ksi | BW | 10 Years | 3000 hours |
| N | 77 | 49 | 70 | 2.0/2.5 | 78 | 75 |
| O | 75 | 49 | 70 | 1.5/2.5 | 82 | 84 |
| *P | 75 | 57.4 | 82 | 1.8/2.3 | 95 | 92 |

Table 6 shows the stress relaxation of the alloys of the invention is better than that of either binary copper-zirconium alloys (alloys C and Q) or ternary copper-zirconium-chromium alloys (alloy A). In the second column of Table 6, "process type":

Aged=processing according to Process 1.

2-IPA=processing according to Process 2, with 2 In Process Anneals.

1-IPA=processing according to Process 2 with the second precipitation hardening anneal (40 in FIG. 3) deleted, 1 In Process Anneal.

One application for which the alloys of the invention are particularly suited is a leadframe for an electronic package as shown in Table 7. Alloys N and O represent alloys conventionally used in electronic packaging applications. Alloy N is copper alloy C197 and alloy O is C18070, a commercially available leadframe alloy. The alloy of the invention, alloy P, has a conductivity equivalent to those of the conventional leadframe alloys. The alloy P yield strength is considerably higher than that of alloys N and O. The minimum bend radius is less for alloy P and the resistance to stress relaxation is significantly improved.

Table 8 shows the benefit of the third process which is illustrated in FIG. 7. Table 8 illustrates the advantage of the second recrystallization anneal and also that the temperature of the first recrystallization anneal may vary over a significant range. The alloy processed as indicated in Table 8 had the analyzed composition, by weight, 0.36% cobalt, 0.32% chromium, 0.16% titanium, 0.16% zirconium and the balance copper at substantially equivalent yield strengths and electrical conductivity values.

TABLE 8

| Process | A | B | C | D |
|---|---|---|---|---|
| 1st Recrystallization | 925° C. 1 min. | 830° C. 4 min. | 650° C. 6 hr. | 925° C. 1 min. |
| 2nd Recrystallization | 925° C. 1 min. | 925° C. 1 min. | 925° C. 1 min. | none |
| MBR/t GW/BW | 1.7/1.4 | 1.7/1.5 | 1.7/1.1 | 2.4/2.4 |

Table 9 illustrates the benefit of the third process as illustrated in FIG. 7 to another copper-chromium-zirconium alloy, C18100. The alloy has the analyzed composition, by weight, of 0.78% chromium, 0.15% zirconium, 0.075% magnesium and the balance copper at substantially equivalent yield strengths and electrical conductivity values.

TABLE 9

| Process | A | B |
|---|---|---|
| 1st recrystallization | 925° C. 1 min. | 925° C. 1 min. |
| 2nd recrystallization | 925° C. 1 min. | none |
| MBR/t GW/BW | 1.7/1.7 | 1.9/2.0 |

While the alloys of the invention have particular utility for electrical and electronic applications such as electrical connectors and leadframes, the alloys may be used for any application in which high strength and/or good electrical conductivity is required. Such applications include conductive rods, wires and buss bars. Other applications include those requiring high electrical conductivity and resistance to stress relaxation such as welding electrodes.

The patents cited herein are intended to be incorporated by reference in their entireties.

It is apparent that there has been provided in accordance with this invention a copper alloy characterized by high strength and high electrical conductivity which is particularly suited for electric and electronic applications which fully satisfies the objects, means and advantages set forth hereinbefore. While the invention has been described in combination with specific embodiments and examples thereof, it is evident that may alternatives, modifications and variations will be apparent to those skilled in the art in light of the foregoing description. Accordingly, it intended to embrace all such alternatives, modifications and variations as fall within the spirit and broad scope of the appended claims.

We claim:

1. A method for the manufacture of a copper alloy, comprising the steps of:

a) casting a precipitation hardenable copper alloy containing from about 0.001% to about 2.0% by weight chromium and from about 0.001% to about 2.0% by weight zirconium;

b) heating said copper alloy for at least partial homogenization;

c) hot rolling said copper alloy to an area reduction in excess of about 50%;

d) cold rolling said copper alloy to an area reduction in excess of about 25%;

e) recrystallizing said copper alloy for a first time;

f) cold rolling said copper alloy to a cross sectional area reduction of from about 40% to about 90%;

g) recrystallizing said copper alloy for a second time at a temperature effective to produce the desired aging response during precipitation aging;

h) cold rolling said copper alloy to final gauge; and i) precipitation aging said copper alloy.

2. The method of claim 1 wherein in step g, said copper alloy is recrystallized a second time at a temperature in excess of 925° C.

3. The method of claim 2 wherein the temperature for recrystallization in step e and in step g is independently between about 500° C. and the solidus temperature of said copper alloy.

4. The method of claim 3 wherein the temperature for recrystallization in step e and in step g is independently between about 800° C. and 950° C.

5. The method of claim 3 wherein the dwell time for recrystallization in step e and step g is independently between about 5 seconds and 16 hours.

6. The method of claim 5 wherein the dwell time for recrystallization in step e and step g is independently between about 30 seconds and 5 minutes.

7. The method of claim 6 wherein the precipitation aging temperature of step i is from about 350° C. to about 600° C. and the dwell time is from about 15 minutes to about 16 hours.

8. The method of claim 4 wherein said alloy is selected to consist essentially of 0.4%–1.2% by weight chromium, 0.08%–0.2% zirconium, 0.03%–0.06% magnesium and the balance copper.

9. The method of claim 4 wherein said alloy is selected to consist essentially of from an effective amount to increase strength up to about 1.0% by weight chromium, from about 0.05% to about 0.40% by weight zirconium, from about 0.1 to about 1.0% by weight of "M" where "M" is selected from the group consisting of cobalt, iron, nickel and mixtures thereof with a maximum nickel content of about 0.25% by weight, and from about 0.05% to about 0.7% by weight titanium where the atomic ratio of "M" to titanium, M:Ti, is from about 1.2:1 to about 7.0:1.

* * * * *